US011177069B2

(12) United States Patent
Kuniyoshi

(10) Patent No.: US 11,177,069 B2
(45) **Date of Patent: *Nov. 16, 2021**

(54) METHOD FOR PRODUCING R-T-B SYSTEM SINTERED MAGNET

(71) Applicant: HITACHI METALS, LTD., Tokyo (JP)

(72) Inventor: Futoshi Kuniyoshi, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 808 days.

This patent is subject to a terminal disclaimer.

(21) Appl. No.: 15/548,466

(22) PCT Filed: Jul. 20, 2016

(86) PCT No.: PCT/JP2016/071244

§ 371 (c)(1),
(2) Date: Aug. 3, 2017

(87) PCT Pub. No.: WO2017/018291

PCT Pub. Date: Feb. 2, 2017

(65) Prior Publication Data

US 2018/0240590 A1 Aug. 23, 2018

(30) Foreign Application Priority Data

Jul. 30, 2015 (JP) ..... JP2015-150585
Feb. 16, 2016 (JP) ..... JP2016-026583

(51) Int. Cl.
*H01F 41/02* (2006.01)
*B22F 3/24* (2006.01)
(Continued)

(52) U.S. Cl.
CPC ..... *H01F 41/0293* (2013.01); *B22F 3/1007* (2013.01); *B22F 3/24* (2013.01);
(Continued)

(58) Field of Classification Search
CPC .. H01F 41/0293; H01F 41/02; H01F 41/0266; H01F 1/057; H01F 1/0577;
(Continued)

(56) References Cited

U.S. PATENT DOCUMENTS 8,846,136 B2 * 9/2014 Shoji ..... H01F 1/0577 148/302
2010/0119703 A1 * 5/2010 Sagawa ..... C22C 38/16 427/127
(Continued)

FOREIGN PATENT DOCUMENTS

JP 09-129424 A 5/1997
JP 2012-094813 A 5/2012
(Continued)

OTHER PUBLICATIONS

Official Communication issued in International Patent Application No. PCT/JP2016/071244, dated Oct. 4, 2016.

*Primary Examiner* — Alexandra M Moore
(74) *Attorney, Agent, or Firm* — Keating & Bennett, LLP

(57) ABSTRACT

A sintered R-T-B based magnet work contains R: 27.5 to 35.0 mass % (R is at least one rare-earth element which always includes Nd), B: 0.80 to 0.99 mass %, Ga: 0 to 0.8 mass %, M: 0 to 2 mass % (M is at least one of Cu, Al, Nb and Zr), and a balance T (T is at least one transition metal element which always includes Fe, with 10% or less of Fe replaceable by Co). [T]/55.85>14[B]/10.8 is satisfied where [T] is the T content (mass %) and [B] is the B content (mass %). At least a portion of a Pr—Ga alloy is in contact with a portion of the sintered magnet work surface, and a first heat treatment is performed at a temperature between 600° C. and 950° C. A second heat treatment is performed at a temperature lower than the temperature of the first heat treatment and between 450° C. and 750° C.

6 Claims, 2 Drawing Sheets

(51) Int. Cl.

| | |
|---|---|
| ***H01F 1/057*** | (2006.01) |
| ***C22C 38/00*** | (2006.01) |
| ***H01F 1/08*** | (2006.01) |
| ***C22F 1/00*** | (2006.01) |
| ***C21D 6/00*** | (2006.01) |
| ***C22C 28/00*** | (2006.01) |
| ***C22C 33/02*** | (2006.01) |
| ***C22C 1/04*** | (2006.01) |
| ***H01F 1/03*** | (2006.01) |
| ***B22F 3/10*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |

(52) U.S. Cl.
CPC ..... *C21D 6/00* (2013.01); *C22C 1/0433* (2013.01); *C22C 28/00* (2013.01); *C22C 33/0278* (2013.01); *C22C 38/00* (2013.01); *C22C 38/005* (2013.01); *C22C 38/06* (2013.01); *C22C 38/10* (2013.01); *C22C 38/12* (2013.01); *C22C 38/14* (2013.01); *C22C 38/16* (2013.01); *C22F 1/00* (2013.01); *H01F 1/03* (2013.01); *H01F 1/057* (2013.01); *H01F 1/0577* (2013.01); *H01F 1/08* (2013.01); *H01F 41/02* (2013.01); *H01F 41/0266* (2013.01); *B22F 2003/248* (2013.01); *B22F 2201/20* (2013.01); *B22F 2202/05* (2013.01); *B22F 2301/355* (2013.01); *B22F 2999/00* (2013.01); *C22C 2202/02* (2013.01)

(58) Field of Classification Search
CPC .. H01F 1/08; H01F 1/03; B22F 3/1007; B22F 3/24; B22F 2999/00; B22F 2003/248; B22F 2201/20; B22F 2202/05; B22F 2301/355; C21D 6/00; C22C 38/00; C22C 38/005; C22C 38/06; C22C 38/10; C22C 38/12; C22C 38/14; C22C 38/16; C22C 28/00; C22C 2202/02; C22C 1/0433; C22C 33/0278; C22F 1/00
See application file for complete search history.

(56) References Cited

U.S. PATENT DOCUMENTS

| | | | | |
|---|---|---|---|---|
| 2013/0181039 | A1 | 7/2013 | Obata | |
| 2014/0132377 | A1 | 5/2014 | Nakajima et al. | |
| 2014/0184370 | A1 | 7/2014 | Hidaka et al. | |
| 2014/0290803 | A1* | 10/2014 | Kato | H01F 1/0577 148/302 |
| 2015/0235747 | A1 | 8/2015 | Miyamoto et al. | |
| 2016/0163434 | A1 | 6/2016 | Kanada et al. | |
| 2016/0180993 | A1 | 6/2016 | Kanada et al. | |
| 2016/0196904 | A1* | 7/2016 | Kanada | C22C 38/10 420/83 |
| 2018/0025819 | A1* | 1/2018 | Shigemoto | B22F 3/24 419/23 |
| 2018/0047504 | A1* | 2/2018 | Nishiuchi | C22C 28/00 |

FOREIGN PATENT DOCUMENTS

| | | | |
|---|---|---|---|
| JP | 2014-086529 | A | 5/2014 |
| WO | 2012/161355 | A1 | 11/2012 |
| WO | 2013/008756 | A1 | 1/2013 |
| WO | 2015/020181 | A1 | 2/2015 |
| WO | 2015/020182 | A1 | 2/2015 |
| WO | 2015/020183 | A1 | 2/2015 |

* cited by examiner

METHOD FOR PRODUCING R-T-B SYSTEM SINTERED MAGNET

TECHNICAL FIELD

The present invention relates to a method for producing a sintered R-T-B based magnet.

BACKGROUND ART

Sintered R-T-B based magnets (where R is at least one rare-earth element which always includes Nd; (where T is Fe, or Fe and Co; and B is boron) are known as permanent magnets with the highest performance, and are used in voice coil motors (VCM) of hard disk drives, various types of motors such as motors for electric vehicles (EV, HV, PHV, etc.) and motors for industrial equipment, home appliance products, and the like.

A sintered R-T-B based magnet is composed of a main phase which mainly consists of an $R_2T_{14}B$ compound and a grain boundary phase which is at the grain boundaries of the main phase. The main phase, i.e., the $R_2T_{14}B$ compound, is a ferromagnetic material having high saturation magnetization and an anisotropy field, and provides a basis for the properties of a sintered R-T-B based magnet.

Coercivity $H_{cJ}$ (which hereinafter may be simply referred to as "$H_{cJ}$") of sintered R-T-B based magnets decreases at high temperatures, thus causing an irreversible flux loss. For this reason, sintered R-T-B based magnets for use in motors for electric vehicles, in particular, are required to have high $H_{cJ}$.

It is known that $H_{cJ}$ is improved if a light rare-earth element RL (e.g., Nd or Pr) contained in the R of the $R_2T_{14}B$ compound of a sintered R-T-B based magnet is partially replaced with a heavy rare-earth element RH (e.g., Dy or Tb). $H_{cJ}$ is more improved as the amount of substituted RH increases.

However, replacing RL in the $R_2T_{14}B$ compound with RH may improve the $H_{cJ}$ of the sintered R-T-B based magnet, but decrease its remanence $B_r$ (which hereinafter may be simply referred to as "$B_r$"). Moreover, RHs, in particular Dy and the like, are scarce resource, and they yield only in limited regions. For this and other reasons, they have problems of instable supply, significantly fluctuating prices, and so on. Therefore, in recent years, there has been a desire for improved $H_{cJ}$ while using as little RH as possible.

Patent Document 1 discloses a sintered R-T-B based rare-earth magnet which provides high coercivity while keeping the Dy content low. The composition of this sintered magnet is limited to a specific range characterized by relatively small B amounts as compared to any R-T-B type alloys which have been commonly used, and contains one or more metallic elements M selected from among Al, Ga and Cu. As a result, an $R_2T_{17}$ phase is formed at the grain boundaries, and, from this $R_2T_{17}$ phase, a transition metal-rich phase ($R_6T_{13}M$) is formed at the grain boundaries with an increased volumetric proportion, whereby $H_{cJ}$ is improved.

CITATION LIST

Patent Literature

[Patent Document 1] International Publication No. 2013/008756

SUMMARY OF INVENTION

Technical Problem

Although the sintered R-T-B based rare-earth magnet disclosed in Patent Document 1 provides high $H_{cJ}$ while reducing the Dy content, it has a problem of greatly reduced $B_r$. Moreover, in recent years, there has been a desire for sintered R-T-B based magnets having even higher $H_{cJ}$, in applications such as motors for electric vehicles.

Various embodiments of the present invention provide methods for producing sintered R-T-B based magnets which have high $B_r$ and high $H_{cJ}$ while keeping the RH content reduced.

Solution to Problem

A method for producing a sintered R-T-B based magnet according to the present disclosure comprises:

a step of providing a sintered R-T-B based magnet work, containing

R: 27.5 to 35.0 mass % (where R is at least one rare-earth element which always includes Nd), B: 0.80 to 0.99 mass %, Ga: 0 to 0.8 mass %, and M: 0 to 2 mass % (where M is at least one of Cu, Al, Nb and Zr), and including a balance T (where T is Fe, or Fe and Co) and inevitable impurities, the sintered R-T-B based magnet work having a composition satisfying Inequality (1) below:

$$[T]/55.85>14[B]/10.8 \quad (1)$$

([T] is the T content by mass %; and [B] is the B content by mass %);

a step of providing a Pr—Ga alloy (Pr accounts for 65 to 97 mass % of the entire Pr—Ga alloy; 20 mass % or less of Pr is replaceable by Nd; and 30 mass % or less of Pr is replaceable by Dy and/or Tb. Ga accounts for 3 mass % to 35 mass % of the entire Pr—Ga alloy; and 50 mass % or less of Ga is replaceable by Cu. Inclusion of inevitable impurities is possible);

a step of, while allowing at least a portion of the Pr—Ga alloy to be in contact with at least a portion of a surface of the sintered R-T-B based magnet work, performing a first heat treatment at a temperature which is greater than 600° C. but equal to or less than 950° C. in a vacuum or an inert gas ambient; and a step of performing a second heat treatment in a vacuum or an inert gas ambient for the sintered R-T-B based magnet work having been subjected to the first heat treatment, at a temperature which is lower than the temperature effected in the step of performing the first heat treatment but which is not less than 450° C. and not greater than 750° C.

In one embodiment, the Ga amount in the sintered R-T-B based magnet work is 0 to 0.5 mass %.

In one embodiment, the Nd content in the Pr—Ga alloy is equal to or less than the content of inevitable impurities.

In one embodiment, the sintered R-T-B based magnet having been subjected to the first heat treatment is cooled to 300° C. at a cooling rate of 5° C./minute or more, from the temperature at which the first heat treatment was performed.

In one embodiment, the cooling rate is 15° C./minute or more.

Advantageous Effects of Invention

According to embodiments of the present disclosure, a sintered R-T-B based magnet work is subjected to a heat treatment while being in contact with a Pr—Ga alloy, whereby Pr and Ga can be diffused throughout the grain boundaries without hardly diffusing into the main phase. The presence of Pr promotes diffusion in the grain boundaries, thereby allowing Pr and Ga to diffuse deep in the magnet interior. This makes it possible to achieve high $B_r$ and high $H_{cJ}$ while reducing the RH content.

DESCRIPTION OF EMBODIMENTS

Figure 1:
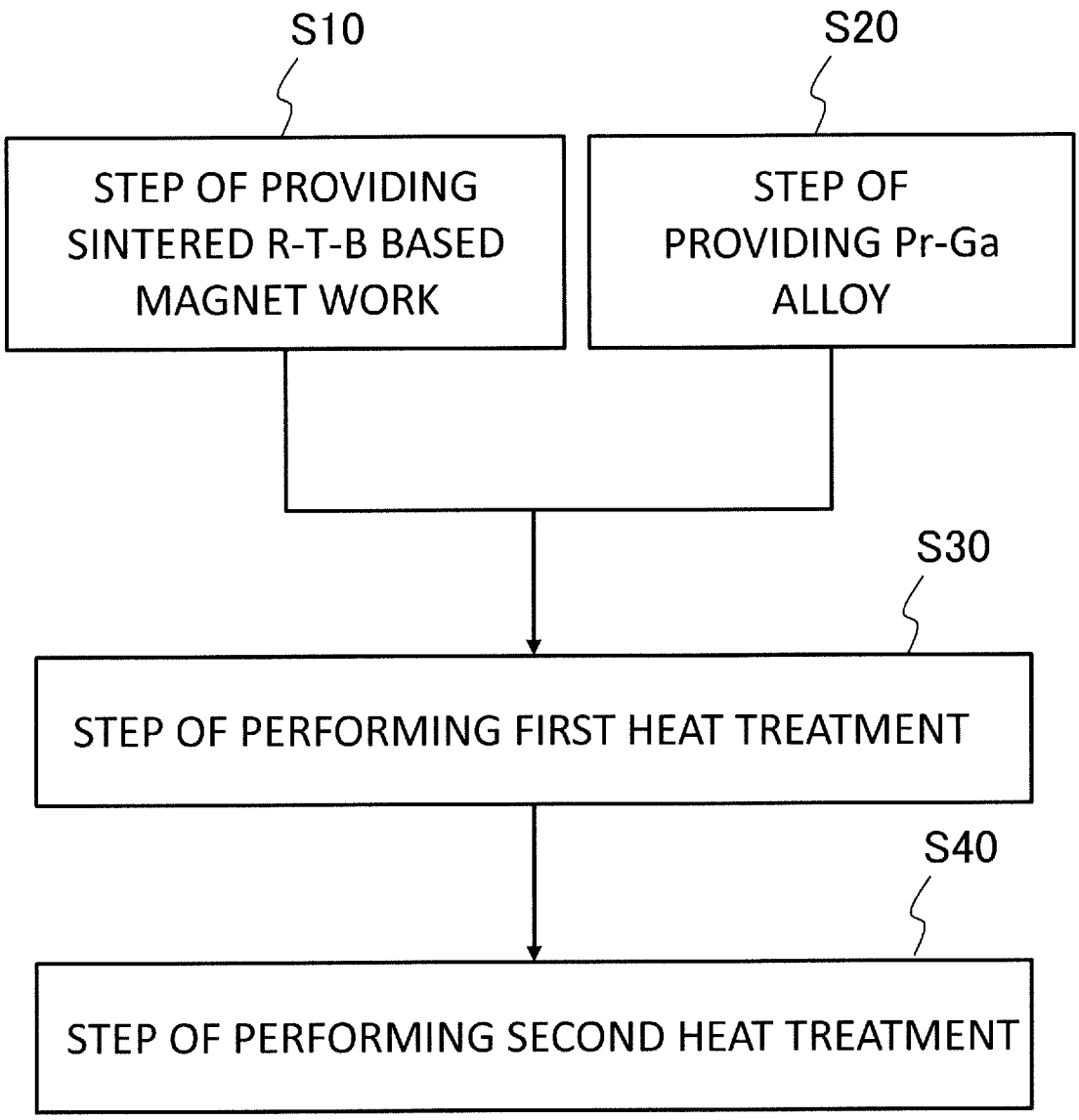
FIG. 1 A flowchart showing example steps in a method for producing a sintered R-T-B based magnet according to the present disclosure.

As shown in FIG. 1, a method for producing a sintered R-T-B based magnet according to the present disclosure includes step S10 of providing a sintered R-T-B based magnet work and step S20 of providing a Pr—Ga alloy. The order of step S10 of providing a sintered R-T-B based magnet work and step S20 of providing a Pr—Ga alloy may be arbitrary, and a sintered R-T-B based magnet work and a Pr—Ga alloy which have been produced in different places may be used.

The sintered R-T-B based magnet work contains

R: 27.5 to 35.0 mass % (where R is at least one rare-earth element which always includes Nd)

B: 0.80 to 0.99 mass %

Ga: 0 to 0.8 mass %

M: 0 to 2 mass % (where M is at least one of Cu, Al, Nb and Zr), and includes a balance T (where T is Fe, or Fe and Co), and inevitable impurities.

This sintered R-T-B based magnet work satisfies the following Inequality (1), where the T content (mass %) is denoted as [T] and the B content (mass %) is denoted as [B].

$$[T]/55.85>14[B]/10.8 \quad (1)$$

This inequality being satisfied means that the B content is smaller than the stoichiometric mole fraction in the $R_2T_{14}B$ compound, that is, the B amount is small relative to the T amount that is consumed in forming the main phase ($R_2T_{14}B$ compound).

The Pr—Ga alloy is an alloy of Pr in an amount of 65 to 97 mass and Ga in an amount of 3 mass % to 35 mass %. However, 20 mass % or less of Pr may be replaced by Nd. Moreover, 30 mass % or less of Pr may be replaced by Dy and/or Tb. Furthermore, 50 mass % or less of Ga may be replaced by Cu. The Pr—Ga alloy may contain inevitable impurities.

As shown in FIG. 1, the method for producing a sintered R-T-B based magnet according to the present disclosure further includes: step S30 of, while allowing at least a portion of the Pr—Ga alloy to be in contact with at least a portion of the surface of the sintered R-T-B based magnet work, performing a first heat treatment at a temperature which is greater than 600° C. but equal to or less than 950° C. in a vacuum or an inert gas ambient; and step S40 of performing a second heat treatment in a vacuum or an inert gas ambient for the sintered R-T-B based magnet work having been subjected to the first heat treatment, at a temperature which is lower than the temperature effected in the step of performing the first heat treatment but which is not less than 450° C. and not greater than 750° C. Step S30 of performing the first heat treatment is performed before step S40 of performing the second heat treatment. Between step S30 of performing the first heat treatment and step S40 of performing the second heat treatment, any other step, e.g., a cooling step, a step of retrieving the sintered R-T-B based magnet work out of a mixture of the Pr—Ga alloy and the sintered R-T-B based magnet work, or the like may be performed.

1. Mechanism

The sintered R-T-B based magnet has a structure such that powder particles of a raw material alloy have bound together through sintering, and is composed of a main phase which mainly consists of an $R_2T_{14}B$ compound and a grain boundary phase which is at the grain boundaries of the main phase.

Figure 2A:
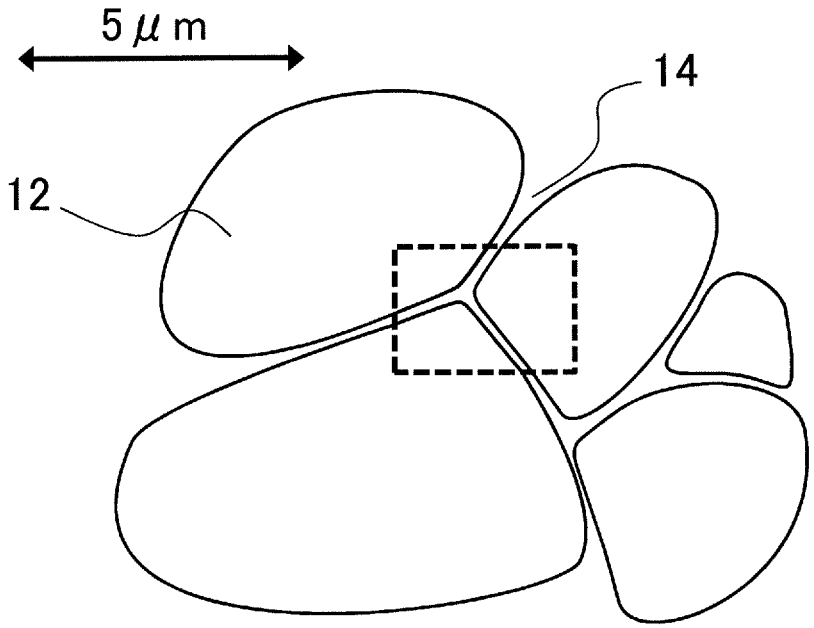
FIG. 2A A partially enlarged cross-sectional view schematically showing a sintered R-T-B based magnet.
Figure 2B:
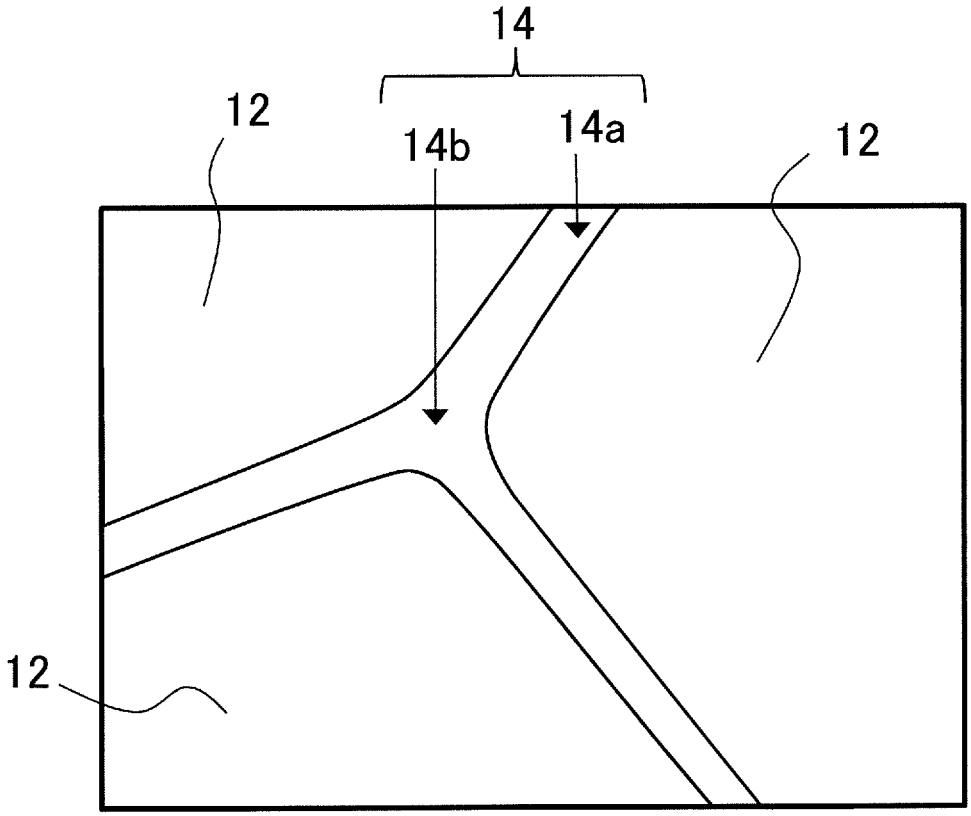
FIG. 2B A further enlarged cross-sectional view schematically showing the interior of a broken-lined rectangular region in FIG. 2A.

FIG. 2A is a partially enlarged cross-sectional view schematically showing a sintered R-T-B based magnet. FIG. 2B is a further enlarged cross-sectional view schematically showing the interior of a broken-lined rectangular region in FIG. 2A. In FIG. 2A, arrowheads indicating a length of 5 μm are shown as an example of reference length to represent size. As shown in FIG. 2A and FIG. 2B, the sintered R-T-B based magnet is composed of a main phase which mainly consists of an $R_2T_{14}B$ compound 12 and a grain boundary phase 14 which is at the grain boundaries of the main phase 12. Moreover, as shown in FIG. 2B, the grain boundary phase 14 includes a double grain boundary phase 14*a* in which two $R_2T_{14}B$ compound grains adjoining each other, and grain boundary triple junctions 14*b* at which three $R_2T_{14}B$ compound grains adjoin one another.

The main phase 12, i.e., the $R_2T_{14}B$ compound, is a ferromagnetic material having high saturation magnetization and an anisotropy field. Therefore, in a sintered R-T-B based magnet, it is possible to improve $B_r$ by increasing the abundance ratio of the $R_2T_{14}B$ compound which is the main phase 12. In order to increase the abundance ratio of the $R_2T_{14}B$ compound, the R amount, the T amount, and the B amount in the raw material alloy may be brought closer to the stoichiometric ratio of the $R_2T_{14}B$ compound (i.e., the R amount: the T amount: the B amount=2:14:1). When the B amount or the R amount belonging in the $R_2T_{14}B$ compound falls lower than the stoichiometric ratio, a magnetic substance such as an Fe phase or an $R_2T_{17}$ phase occurs in the grain boundary phase 14, whereby $H_{cJ}$ is drastically decreased. However, it has been believed that, when Ga is contained in the magnet composition, even if e.g. the B amount falls lower than the stoichiometric ratio, an R-T-Ga phase will occur at the grain boundaries instead of an Fe phase and an $R_2T_{17}$ phase, thereby being able to suppress the decrease in $H_{cJ}$.

It has however been found through a study by the inventors that, when Ga is added in the raw material alloy or in a raw material alloy powder that is formed by pulverizing the raw material alloy, some of the Ga may become contained not only in the grain boundary phase 14 but also in the main phase 12, thereby lowering magnetization of the main phase 12 and consequently lowering $B_r$. Therefore, in order to obtain high $B_r$, the amount of Ga added needs to be reduced. On the other hand, if too small an amount of Ga is added, then the Fe phase and $R_2T_{17}$ phase will remain in the grain boundary phase 14, thus lowering $H_{cJ}$. In other words, it has been found difficult to reconcile high $B_r$ and high $H_{cJ}$ in the case where Ga is added in the raw material alloy and/or in the raw material alloy powder.

Through further studies directed to solving the aforementioned problem, it has been found possible to restrain some of the Ga from being contained in the main phase 12 by allowing at least a portion of a Pr—Ga alloy to be in contact with at least a portion of the surface of the sintered R-T-B based magnet work of the aforementioned specific composition, and performing a specific heat treatment to introduce Ga into the sintered R-T-B based magnet work. Furthermore, in order for Ga to diffuse into the grain boundary phase 14, it has been found important to allow Ga and Pr to diffuse from the sintered magnet work surface into the interior, by using a Ga-containing alloy whose main component is Pr.

As will be described with respect to the Examples described below, using Nd instead of Pr does not attain as high $B_r$ and high $H_{cJ}$ as in the case of using Pr. This is considered to be because, in the specific composition of the present invention, Pr is more likely to be diffused into the grain boundary phase 14 than is Nd. In other words, it is considered that Pr is a greater ability to permeate the grain boundary phase 14 than does Nd. Since Nd is also likely to permeate the main phase 12, it is considered that use of an Nd—Ga alloy will allow some of the Ga to also be diffused into the main phase 12. In this case, the amount of Ga to be diffused in the main phase 12 is smaller than in the case of adding Ga in the alloy or the alloy powder.

According to the present invention, by using a Pr—Ga alloy, Pr and Ga can be diffused throughout the grain boundaries without hardly diffusing into the main phase. Moreover, the presence of Pr promotes diffusion in the grain boundaries, thereby allowing Ga to diffuse deep in the magnet interior. This is the presumable reason for being able to achieve high $B_r$ and high $H_{cJ}$.

2. Terminology (a Sintered R-T-B Based Magnet Work and a Sintered R-T-B Based Magnet)

In the present invention, any sintered R-T-B based magnet prior to a first heat treatment or during a first heat treatment will be referred to as a "sintered R-T-B based magnet work"; any sintered R-T-B based magnet after a first heat treatment but prior to or during a second heat treatment will be referred to as a "sintered R-T-B based magnet work having been subjected to a/the first heat treatment"; and any sintered R-T-B based magnet after the second heat treatment will be simply referred to as a "sintered R-T-B based magnet".

(R-T-Ga Phase)

An R-T-Ga phase is a compound containing R, T and Ga, a typical example thereof being an $R_6T_{13}Ga$ compound. An $R_6T_{13}Ga$ compound has a $La_6Co_{11}Ga_3$ type crystal structure. An $R_6T_{13}Ga$ compound may take the form of an $R_6T_{13-}\delta Ga_{1+}\delta$ compound. In the case where Cu, Al and Si are contained in the sintered R-T-B based magnet, the R-T-Ga phase may be $R_6T_{13-}\delta(Ga_{1-x-y-z}Cu_xAl_ySi_z)_{1+}\delta$.

3. Reasons for the Limited Composition and so on (R)

The R content is 27.5 to 35.0 mass %. R is at least one rare-earth element which always includes Nd. If R is less than 27.5 mass %, a liquid phase will not sufficiently occur in the sintering process, and it will be difficult for the sinter to become adequately dense in texture. On the other hand, if R exceeds 35.0 mass %, effects of the present invention will be obtained, but the alloy powder during the production steps of the sinter will be very active, and considerable oxidization, ignition, etc. of the alloy powder may possibly occur; therefore, it is preferably 35 mass % or less. More preferably, R is 28 mass % to 33 mass %; and still more preferably, R is 29 mass % to 33 mass %. The RH content is preferably 5 mass % or less of the entire sintered R-T-B based magnet. According to the present invention, high $B_r$ and high $H_{cJ}$ can be achieved without the use of RH; this makes it possible to reduce the amount of RH added even when a higher $H_{cJ}$ is desired.

(B)

The B content is 0.80 to 0.99 mass %. By allowing the Pr—Ga alloy described below to be diffused in a sintered R-T-B based magnet work which has 0.80 to 0.99 mass % of B content while satisfying Inequality (1), an R-T-Ga phase can be generated. If the B content is less than 0.80 mass %, $B_r$ may be decreased; if it exceeds 0.99 mass %, the amount of R-T-Ga phase generated may be so small that $H_{cJ}$ may be decreased. Moreover, B may be partially replaced by C.

(Ga)

The Ga content in the sintered R-T-B based magnet work before Ga is diffused from the Pr—Ga alloy is 0 to 0.8 mass %. In the present invention, Ga is introduced by diffusing a Pr—Ga alloy in the sintered R-T-B based magnet work; therefore, it is ensured that the Ga amount in the sintered R-T-B based magnet work is relatively small (or that no Ga is contained). If the Ga content exceeds 0.8 mass %, magnetization of the main phase may become lowered due to Ga being contained in the main phase as described above, so that high $B_r$ may not be obtained. Preferably, the Ga content is 0.5 mass % or less. A higher $B_r$ can be obtained.

(M)

The M content is 0 to 2 mass %. M is at least one of Cu, Al, Nb and Zr; although it may be 0 mass % and still the effects of the present invention will be obtained, a total of 2 mass % or less of Cu, Al, Nb and Zr may be contained. Cu and/or Al being contained can improve $H_{cJ}$. Cu and/or Al may be purposely added, or those which will be inevitably introduced during the production process of the raw material or alloy powder used may be utilized (a raw material containing Cu and/or Al as impurities may be used). Moreover, Nb and/or Zr being contained will suppress abnormal grain growth of crystal grains during sintering. Preferably, M always contains Cu, such that Cu is contained in an amount of 0.05 to 0.30 mass %. The reason is that Cu being contained in an amount of 0.05 to 0.30 mass % will allow $H_{cJ}$ to be improved.

(Balance T)

The balance, T (where T is Fe, or Fe and Co), satisfies Inequality (1). Preferably, 90% or more by mass ratio of T is Fe. Fe may be partially replaced by Co. However, if the amount of substituted Co exceeds 10% by mass ratio of the entire T, $B_r$ will be decreased, which is not preferable. Furthermore, the sintered R-T-B based magnet work according to the present invention may contain inevitable impurities that will usually be contained in the alloy or during the production steps, e.g., didymium alloys (Nd—Pr), electrolytic iron, ferroboron, as well as small amounts of elements other than the aforementioned (i.e., elements other than R, B, Ga, M and T mentioned above). For example, Ti, V, Cr, Mn, Ni, Si, La, Ce, Sm, Ca, Mg, O (oxygen), N (carbon), C (nitrogen), Mo, Hf, Ta, W, and the like may each be contained.

(Inequality (1))

When Inequality (1) is satisfied, the B content is smaller than in commonly-available sintered R-T-B based magnets. Commonly-available sintered R-T-B based magnets have compositions in which [T]/55.85 (i.e., the atomic weight of Fe) is smaller than 14[B]/10.8 (i.e., the atomic weight of B), in order to ensure that an Fe phase or an $R_2T_{17}$ phase will not occur in addition to the main phase, i.e., an $R_2T_{14}B$ phase (where [T] is the T content by mass %; and [B] is the B content by mass %). Unlike in commonly-available sintered R-T-B based magnets, the sintered R-T-B based magnet according to the present invention is defined by Inequality (1) so that [T]/55.85 (i.e., the atomic weight of Fe) is greater than 14[B]/10.8 (i.e., the atomic weight of B). The reason for reciting the atomic weight of Fe is that the main component of T in the sintered R-T-B based magnet according to the present invention is Fe.

(Pr—Ga Alloy)

In the Pr—Ga alloy, Pr accounts for 65 to 97 mass % of the entire Pr—Ga alloy, in which 20 mass % or less of Pr may be replaced by Nd, and 30 mass % or less of Pr may be replaced by Dy and/or Tb. Ga accounts for 3 mass % to 35 mass % of the entire Pr—Ga alloy, in which 50 mass % or less of Ga may be replaced by Cu. Inevitable impurities may be contained. In the present invention, that "20% or less of Pr may be replaced by Nd" means that, given a Pr content (mass %) in the Pr—Ga alloy being defined as 100%, 20% thereof may be replaced by Nd. For example, if Pr accounts for 65 mass % in the Pr—Ga alloy (i.e., Ga accounts for 35 mass %), then Nd may be substituted up to 13 mass %. This will result in Pr accounting for 52 mass % and Nd accounting for 13 mass %. The same also applies to Dy, Tb and Cu. Given a sintered R-T-B based magnet work which is in the composition range according to the present invention, the below-described first heat treatment may be applied to a Pr—Ga alloy in which Pr and Ga are present in the aforementioned ranges, whereby Ga can be diffused deep in the magnet interior via the grain boundaries. The present invention is characterized by the use of a Ga-containing alloy whose main component is Pr. Although Pr may be replaced by Nd, Dy and/or Tb, it should be noted that if their respective substituted amounts exceed the aforementioned ranges, there will be too little Pr to achieve high $B_r$ and high $H_{cJ}$. Preferably, the Nd content in the Pr—Ga alloy is equal to or less than the content of inevitable impurities (approximately 1 mass % or less). Although 50% or less of Ga may be replaced by Cu, a decrease in $H_{cJ}$ may result if the amount of substituted Cu exceeds 50%.

The shape and size of the Pr—Ga alloy are not particularly limited, and may be arbitrarily selected. The Pr—Ga alloy may take the shape of a film, a foil, powder, a block, particles, or the like.

4. Providing Steps (Step of Providing a Sintered R-T-B Based Magnet Work)

A sintered R-T-B based magnet work can be provided by a generic method for producing a sintered R-T-B based magnet, such as an Nd—Fe—B type sintered magnet. As one example, a raw material alloy which is produced by a strip casting method or the like may be pulverized to not less than 1 μm and not more than 10 μm by using a jet mill or the like, thereafter pressed in a magnetic field, and then sintered at a temperature of not less than 900° C. and not more than 1100° C.

If the pulverized particle size (having a central value of volume as obtained by an airflow-dispersion laser diffraction method=D50) of the raw material alloy is less than 1 μm, it becomes very difficult to produce pulverized powder, thus resulting in a greatly reduced production efficiency, which is not preferable. On the other hand, if the pulverized particle size exceeds 10 μm, the sintered R-T-B based magnet work as finally obtained will have too large a crystal grain size to achieve high $H_{cJ}$, which is not preferable. So long as the aforementioned conditions are satisfied, the sintered R-T-B based magnet work may be produced from one kind of raw material alloy (a single raw-material alloy), or through a method of using two or more kinds of raw material alloys and mixing them (blend method). Moreover, the sintered R-T-B based magnet work may contain inevitable impurities, such as O (oxygen), N (nitrogen), and C (carbon), that may exist in the raw material alloy or introduced during the production steps.

(Step of Providing Pr—Ga Alloy)

The Pr—Ga alloy can be provided by a method of producing a raw material alloy that is adopted in generic methods for producing a sintered R-T-B based magnet, e.g., a mold casting method, a strip casting method, a single roll rapid quenching method (a melt spinning method), an atomizing method, or the like. Moreover, the Pr—Ga alloy may be what is obtained by pulverizing an alloy obtained as above with a known pulverization means such as a pin mill.

5. Heat Treatment Step (Step of Performing First Heat Treatment)

While at least a portion of the Pr—Ga alloy is allowed to be in contact with at least a portion of the surface of the sintered R-T-B based magnet work that has been provided as above, a heat treatment is performed in a vacuum or an inert gas ambient, at a temperature which is greater than 600° C. but equal to or less than 950° C. In the present invention, this heat treatment is referred to as the first heat treatment. As a result of this, a liquid phase containing Pr and Ga emerges from the Pr—Ga alloy, and this liquid phase is introduced from the surface to the interior of the sintered work through diffusion, via grain boundaries in the sintered R-T-B based magnet work. This allows Ga as well as Pr to be diffused deep in the sintered R-T-B based magnet work via the grain boundaries. If the first heat treatment temperature is 600° C. or less, the amount of liquid phase containing Pr and Ga may be too small to achieve high $H_{cJ}$; if it exceeds 950° C., $H_{cJ}$ may be decreased. Preferably, the sintered R-T-B based magnet work having been subjected to the first heat treatment (greater than 600° C. but equal to or less than 940° C.) is cooled to 300° C. at a cooling rate of 5° C./minute or more, from the temperature at which the first heat treatment was performed. A higher $H_{cJ}$ can be obtained. Even more preferably, the cooling rate down to 300° C. is 15° C./minute or more.

The first heat treatment can be performed by placing a Pr—Ga alloy in any arbitrary shape on the sintered R-T-B based magnet work surface, and using a known heat treatment apparatus. For example, the sintered R-T-B based magnet work surface may be covered by a powder layer of the Pr—Ga alloy, and the first heat treatment may be performed. For example, after a slurry obtained by dispersing the Pr—Ga alloy in a dispersion medium is applied on the sintered R-T-B based magnet work surface, the dispersion medium may be evaporated, thus allowing the Pr—Ga alloy to come in contact with the sintered R-T-B based magnet work. Examples of the dispersion medium may be alcohols (ethanol, etc.), aldehydes, and ketones.

(Step of Performing Second Heat Treatment)

A heat treatment is performed in a vacuum or an inert gas ambient for the sintered R-T-B based magnet work having been subjected to the first heat treatment, at a temperature which is lower than the temperature effected in the step of performing the first heat treatment but which is not less than 450° C. and not greater than 750° C. In the present invention, this heat treatment is referred to as the second heat treatment. By performing the second heat treatment, an R-T-Ga phase is generated, whereby high $H_{cJ}$ can be achieved. If the second heat treatment is at a higher temperature than is the first heat treatment, or if the temperature of the second heat treatment is less than 450° C. or exceeds 750° C., the amount of R-T-Ga phase generated will be too small to achieve high $H_{cJ}$.

EXAMPLES

Example 1

[Providing Sintered R-T-B Based Magnet Work]

Raw materials of respective elements were weighed so as to attain the alloy compositions indicated at Nos. A-1 and A-2 in Table 1, and alloys were produced by a strip casting technique. Each resultant alloy was coarse-pulverized by a hydrogen pulverizing method, thus obtaining a coarse-pulverized powder. Next, to the resultant coarse-pulverized powder, zinc stearate was added as a lubricant in an amount of 0.04 mass % relative to 100 mass % of coarse-pulverized powder; after mixing, an airflow crusher (jet mill machine) was used to effect dry milling in a nitrogen jet, whereby a fine-pulverized powder (alloy powder) with a particle size D50 of 4 μm was obtained. To the fine-pulverized powder, zinc stearate was added as a lubricant in an amount of 0.05 mass % relative to 100 mass % of fine-pulverized powder; after mixing, the fine-pulverized powder was pressed in a magnetic field, whereby a compact was obtained. As a pressing apparatus, a so-called orthogonal magnetic field pressing apparatus (transverse magnetic field pressing apparatus) was used, in which the direction of magnetic field application ran orthogonal to the pressurizing direction. In a vacuum, the resultant compact was sintered for 4 hours at not less than 1060° C. and not more than 1090° C. (for each sample, a temperature was selected at which a sufficiently dense texture would result through sintering), whereby a sintered R-T-B based magnet work was obtained. Each resultant sintered R-T-B based magnet work had a density of 7.5 $Mg/m^3$ or more. The components in the resultant sintered R-T-B based magnet works proved to be as shown in Table 1. The respective components in Table 1 were measured by using Inductively Coupled Plasma Optical Emission Spectroscopy (ICP-OES). Any instance of Inequality (1) according to the present invention being satisfied is indicated as "○"; any instance of failing to satisfy it is indicated as "X". The same also applies to Tables 5, 9, 13 and 17 below. Note that each composition in Table 1 does not total to 100 mass %. This is because components (e.g., O (oxygen) and N (nitrogen)) other than the component listed in Table 1 exist. The same also applies to Tables 5, 9, 13 and 17 below.

TABLE 1

| | composition of sintered R-T-B based magnet work (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | Inequality (1) |
| A-1 | 30.0 | 0.0 | 0.0 | 0.0 | 0.89 | 0.1 | 0.1 | 0.0 | 0.0 | 0.0 | 1.0 | 67.1 | ○ |
| A-2 | 30.0 | 1.0 | 0.0 | 0.0 | 0.89 | 0.1 | 0.1 | 0.2 | 0.0 | 0.0 | 1.0 | 67.1 | ○ |

[Providing Pr—Ga Alloy]

Raw materials of respective elements were weighed so as to result in the alloy composition shown as No. a-1 in Table 21, and these raw materials were dissolved; thus, by a single roll rapid quenching method (melt spinning method), an alloy in ribbon or flake form was obtained. Using a mortar, the resultant alloy was pulverized in an argon ambient, and thereafter was passed through a sieve with an opening of 425 μm, thereby providing a Pr—Ga alloy. The composition of the resultant Pr—Ga alloy is shown in Table 2.

TABLE 2

| | composition of Pr—Ga alloy (mass %) | |
|---|---|---|
| No. | Pr | Ga |
| a-1 | 89 | 11 |

[Heat Treatments]

The sintered R-T-B based magnet works of Nos. A-1 and A-2 in Table 1 were cut and ground into 7.4 mm×7.4 mm×7.4 mm cubes. Next, with respect to the sintered R-T-B based magnet work of No. A-1, on its two faces that were perpendicular to the alignment direction, 0.25 parts by mass of Pr—Ga alloy (No. a-1) was spread, relative to 100 parts by mass of sintered R-T-B based magnet work (i.e., 0.125 parts by mass per face). Thereafter, a first heat treatment was performed at a temperature shown in Table 3 in argon which was controlled to a reduced pressure of 50 Pa, followed by a cooling down to room temperature, whereby a sintered R-T-B based magnet work having been subjected to the first heat treatment was obtained. Furthermore, for this sintered R-T-B based magnet work having been subjected to the first heat treatment and No. A-2 (i.e., the sintered R-T-B based magnet work which was not subjected to the first heat treatment), a second heat treatment was performed at a temperature shown in Table 3 in argon which was controlled to a reduced pressure of 50 Pa, thus producing sintered R-T-B based magnets (Nos. 1 and 2). Note that the aforementioned cooling (i.e., cooling down to room temperature after performing the first heat treatment) was conducted by introducing an argon gas in the furnace, so that an average cooling rate of 25° C./minute existed from the temperature at which the heat treatment was effected (i.e., 900° C.) to 300° C. At the average cooling rate (25° C./minute), variation in the cooling rate (i.e., a difference between the highest value and the lowest value of the cooling rate) was within 3° C./minute. Moreover, the composition of the sintered R-T-B based magnet of No. 1 (i.e., the sample in which Pr and Ga were diffused by using a Pr—Ga alloy) was measured by using Inductively Coupled Plasma Optical Emission Spectroscopy (ICP-OES), which revealed a similar composition to that of No. 2 (since No. 2 did not use a Pr—Ga alloy, it was the same composition as that of No. A-2). For No. 1 and No. 2, a surface grinder was used to cut 0.2 mm off the entire surface of each sample, whereby samples respectively in the form of a 7.0 mm×7.0 mm×7.0 mm cube were obtained.

TABLE 3

| No. | producing conditions: sintered R-T-B based magnet work | Pr—Ga alloy | 1st heat treatment | 2nd heat treatment |
|---|---|---|---|---|
| 1 | A-1 | a-1 | 900° C. | 500° C. |
| 2 | A-2 | No 1st heat treatment | | 500° C. |

[Sample Evaluations]

The resultant samples were set in a vibrating-sample magnetometer (VSM: VSM-5SC-10HF manufactured by TOEI INDUSTRY CO., LTD.) including a superconducting coil, and after applying a magnetic field up to 4 MA/m, the magnetic hysteresis curve of the sinter in the alignment direction was measured while sweeping the magnetic field to −4 MA/m. Values of $B_r$ and $H_{cJ}$ as obtained from the resultant hysteresis curve are shown in Table 4.

TABLE 4

| No. | $B_r$ (T) | $H_{cJ}$ (kA/m) | Notes |
|---|---|---|---|
| 1 | 1.40 | 1520 | present invention |
| 2 | 1.38 | 1250 | comparative example |

As described above, although Nos. 1 and 2 are based on essentially the same composition, higher $B_r$ and higher $H_{cJ}$ are achieved by the embodiment of the present invention (No. 1), as indicated in Table 4. Note that examples of the present invention, including Examples described below, all attain magnetic properties as high as $B_r \geq 1.30$ T and $H_{cJ} \geq 1490$ kA/m.

Example 2

A sintered R-T-B based magnet work was produced by a similar method to Example 1, except that the sintered R-T-B based magnet work was adjusted to have the composition indicated at No. B-1 in Table 5.

TABLE 5

| No. | composition of sintered R-T-B based magnet work (mass %): Nd | Pr | Dy | Tb | B | Cu | Al | Ga | Zr | Nb | Co | Fe | Inequality (1) |
|---|---|---|---|---|---|---|---|---|---|---|---|---|---|
| B-1 | 24.0 | 7.0 | 0.0 | 0.0 | 0.88 | 0.1 | 0.1 | 0.2 | 0.0 | 0.0 | 1.0 | 67.1 | ○ |

Pr—Ga alloys were produced by a similar method to Example 1, except for being adjusted so that the Pr—Ga alloys had compositions indicated at Nos. b-1 and b-2 in Table 6.

TABLE 6

| No. | composition of Pr—Ga alloy (mass %): Pr | Nd | Ga | Notes |
|---|---|---|---|---|
| b-1 | 89 | 0 | 11 | present invention |
| b-2 | 0 | 89 | 11 | comparative example |

After processing the sintered R-T-B based magnet work (No. B-1) in a manner similar to Example 1, the Pr—Ga alloy was spread on the sintered R-T-B based magnet work in a manner similar to No. 1 of Example 1; a first heat treatment was performed, and the sintered R-T-B based magnet work having been subjected to the first heat treatment was further subjected to a second heat treatment, thereby producing a sintered R-T-B based magnet (Nos. 3 and 4). The producing conditions (the types of sintered R-T-B based magnet work and Pr—Ga alloy and the temperatures of the first heat treatment and the second heat treatment) are shown in Table 7. Note that the cooling condition after performing the first heat treatment, down to room temperature, was similar to that of Example 1.

TABLE 7

| No. | producing conditions: sintered R-T-B based magnet work | Pr—Ga alloy | 1st heat treatment | 1st heat treatment |
|---|---|---|---|---|
| 3 | B-1 | b-1 | 850° C. | 500° C. |
| 4 | B-1 | b-2 | 850° C. | 500° C. |

Each resultant sample was processed similarly to Example 1, and subjected to measurement under a similar method, thus determining $B_r$ and $H_{cJ}$. The results are shown in Table 8.

TABLE 8

| No. | $B_r$ (T) | $H_{cJ}$ (kA/m) | Notes |
|---|---|---|---|
| 3 | 1.37 | 1620 | present invention |
| 4 | 1.37 | 1320 | comparative example |

As shown in Table 8, No. 3, which is an embodiment of the present invention using a Pr—Ga alloy (No. b-1), attained higher $H_{cJ}$ than did No. 4 using an Nd—Ga alloy (No. b-2).

Example 3

Sintered R-T-B based magnet works were produced by a similar method to Example 1, except that the sintered R-T-B based magnet works were adjusted to have the compositions indicated at Nos. C-1 to C-4 in Table 9.

TABLE 9

| | composition of sintered R-T-B based magnet work (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | Inequality (1) |
| C-1 | 24.0 | 7.0 | 0.0 | 0.0 | 0.86 | 0.1 | 0.1 | 0.2 | 0.0 | 0.0 | 1.0 | 67.1 | ○ |
| C-2 | 24.0 | 7.0 | 0.0 | 0.0 | 0.88 | 0.1 | 0.1 | 0.2 | 0.0 | 0.0 | 1.0 | 67.1 | ○ |
| C-3 | 23.0 | 7.0 | 0.0 | 0.0 | 0.88 | 0.1 | 0.1 | 0.2 | 0.0 | 0.0 | 0.5 | 67.1 | ○ |
| C-4 | 24.0 | 7.0 | 0.0 | 0.0 | 0.84 | 0.1 | 0.2 | 0.0 | 0.0 | 0.0 | 1.0 | 67.1 | ○ |

Pr—Ga alloys were produced by a similar method to Example 1, except for being adjusted so that the Pr—Ga alloys had compositions indicated at Nos. c-1 to c-20 in Table 10.

TABLE 10

| | composition of Pr—Ga alloy (mass %) | | | | | | |
|---|---|---|---|---|---|---|---|
| No. | Nd | Pr | Dy | Tb | Ga | Cu | Notes |
| c-1 | 0 | 60 | 0 | 0 | 40 | 0 | comparative example |
| c-2 | 0 | 65 | 0 | 0 | 35 | 0 | present invention |
| c-3 | 0 | 80 | 0 | 0 | 20 | 0 | present invention |
| c-4 | 0 | 89 | 0 | 0 | 11 | 0 | present invention |
| c-5 | 0 | 97 | 0 | 0 | 3 | 0 | present invention |
| c-6 | 0 | 100 | 0 | 0 | 0 | 0 | comparative example |
| c-7 | 9 | 80 | 0 | 0 | 11 | 0 | present invention |
| c-8 | 17 | 82 | 0 | 0 | 11 | 0 | present invention |
| c-9 | 10 | 65 | 0 | 0 | 15 | 0 | present invention |
| c-10 | 20 | 69 | 0 | 0 | 11 | 0 | comparative example |
| c-11 | 0 | 79 | 0 | 10 | 11 | 0 | present invention |
| c-12 | 0 | 63 | 0 | 26 | 11 | 0 | present invention |
| c-13 | 0 | 79 | 10 | 0 | 11 | 0 | present invention |
| c-14 | 0 | 69 | 10 | 10 | 11 | 0 | present invention |
| c-15 | 0 | 49 | 40 | 0 | 11 | 0 | comparative example |
| c-16 | 0 | 35 | 35 | 0 | 30 | 0 | comparative example |
| c-17 | 0 | 89 | 0 | 0 | 11 | 0 | present invention |
| c-18 | 0 | 89 | 0 | 0 | 8 | 3 | present invention |
| c-19 | 0 | 89 | 0 | 0 | 6 | 5 | present invention |
| c-20 | 0 | 89 | 0 | 0 | 3 | 8 | comparative example |

After processing the sintered R-T-B based magnet work (Nos. C-1 to C-4) in a manner similar to Example 1, the Pr—Ga alloy was spread on the sintered R-T-B based magnet work in a manner similar to No. 1 of Example 1; a first heat treatment was performed, and the sintered R-T-B based magnet work having been subjected to the first heat treatment was further subjected to a second heat treatment, thereby producing a sintered R-T-B based magnet (Nos. 5 to 25). The producing conditions (the types of sintered R-T-B based magnet work and Pr—Ga alloy and the temperatures of the first heat treatment and the second heat treatment) are shown in Table 11. Note that the cooling condition after performing the first heat treatment, down to room temperature, was similar to that of Example 1.

TABLE 11

| | producing conditions | | | |
|---|---|---|---|---|
| No. | sintered R-T-B based magnet work | Pr—Ga alloy | 1st heat treatment | 2nd heat treatment |
| 5 | C-1 | c-1 | 800° C. | 500° C. |
| 6 | C-1 | c-2 | 800° C. | 500° C. |
| 7 | C-1 | c-3 | 800° C. | 500° C. |
| 8 | C-1 | c-4 | 800° C. | 500° C. |
| 9 | C-1 | c-5 | 800° C. | 500° C. |
| 10 | C-1 | c-6 | 800° C. | 500° C. |
| 11 | C-2 | c-7 | 850° C. | 500° C. |
| 12 | C-2 | c-8 | 850° C. | 500° C. |
| 13 | C-2 | c-9 | 850° C. | 500° C. |

TABLE 11-continued

| | producing conditions | | | |
|---|---|---|---|---|
| No. | sintered R-T-B based magnet work | Pr—Ga alloy | 1st heat treatment | 2nd heat treatment |
| 14 | C-2 | c-10 | 850° C. | 500° C. |
| 15 | C-3 | c-4 | 800° C. | 500° C. |
| 16 | C-3 | c-11 | 800° C. | 500° C. |
| 17 | C-3 | c-12 | 800° C. | 500° C. |
| 18 | C-3 | c-13 | 800° C. | 500° C. |
| 19 | C-3 | c-14 | 800° C. | 500° C. |
| 20 | C-3 | c-15 | 800° C. | 500° C. |
| 21 | C-3 | c-16 | 800° C. | 500° C. |
| 22 | C-4 | c-17 | 900° C. | 500° C. |
| 23 | C-4 | c-18 | 900° C. | 500° C. |
| 24 | C-4 | c-19 | 900° C. | 500° C. |
| 25 | C-4 | c-20 | 900° C. | 500° C. |

Each resultant sample was processed similarly to Example 1, and subjected to measurement under a similar method, thus determining $B_r$ and $H_{cJ}$. The results are shown in Table 12.

TABLE 12

| No. | $B_r$ (T) | $H_{cJ}$ (kA/m) | Notes |
|---|---|---|---|
| 5 | 1.36 | 1200 | comparative example |
| 6 | 1.36 | 1500 | present invention |
| 7 | 1.36 | 1550 | present invention |
| 8 | 1.36 | 1630 | present invention |
| 9 | 1.36 | 1600 | present invention |
| 10 | 1.35 | 1250 | comparative example |
| 11 | 1.37 | 1600 | present invention |
| 12 | 1.37 | 1580 | present invention |
| 13 | 1.37 | 1490 | present invention |
| 14 | 1.37 | 1370 | comparative example |
| 15 | 1.37 | 1630 | present invention |
| 16 | 1.37 | 1700 | present invention |
| 17 | 1.37 | 1790 | present invention |
| 18 | 1.37 | 1650 | present invention |
| 19 | 1.37 | 1730 | present invention |
| 20 | 1.37 | 1250 | comparative example |
| 21 | 1.37 | 1230 | comparative example |
| 22 | 1.34 | 1580 | present invention |
| 23 | 1.34 | 1550 | present invention |
| 24 | 1.34 | 1550 | present invention |
| 25 | 1.34 | 1280 | comparative example |

As shown in Table 12, Nos. 6 to 9, 11 to 13, Nos. 15 to 19, and Nos. 22 to 24, which are embodiments of the present invention, attained magnetic properties as high as $B_r \geq 1.30$ T and $H_{cJ} \geq 1490$ kA/m. On the other hand, magnetic properties as high as $B_r \geq 1.30$ T and $H_{cJ} \geq 1490$ kA/m were not attained by: Nos. 5 and 10, in which the Ga content in the Pr—Ga alloy was outside the range of the present invention; Nos. 14, 20 and 21, in which the amounts of substituted Nd and Dy for Pr in the Pr—Ga alloy were outside the ranges of the present invention; and No. 25, in which the amount of substituted Cu for Ga in the Pr—Ga alloy was outside the range of the present invention.

Example 4

Sintered R-T-B based magnet works were produced by a similar method to Example 1, except that the sintered R-T-B based magnet works were adjusted to have the compositions indicated at Nos. D-1 to D-16 in Table 13.

TABLE 13

| | composition of sintered R-T-B based magnet work (mass %) | | | | | | | | | | | | | |
|---|---|---|---|---|---|---|---|---|---|---|---|---|---|---|
| No. | Nd | Pr | Dy | Tb | B | Cu | Al | Ga | Zr | Nb | Co | Fe | Inequality (1) | Notes |
| D-1 | 24.0 | 7.0 | 0.0 | 0.0 | 0.98 | 0.1 | 0.2 | 0.3 | 0.0 | 0.0 | 1.0 | 66.4 | X | comparative example |
| D-2 | 24.0 | 7.0 | 0.0 | 0.0 | 0.90 | 0.1 | 0.2 | 0.3 | 0.0 | 0.0 | 1.0 | 66.5 | ○ | present invention |
| D-3 | 24.0 | 7.0 | 0.0 | 0.0 | 0.85 | 0.1 | 0.2 | 0.3 | 0.0 | 0.0 | 1.0 | 66.6 | ○ | present invention |
| D-4 | 24.0 | 7.0 | 0.0 | 0.0 | 0.80 | 0.1 | 0.2 | 0.3 | 0.0 | 0.0 | 1.0 | 66.6 | ○ | present invention |
| D-5 | 24.0 | 7.0 | 0.0 | 0.0 | 0.78 | 0.1 | 0.2 | 0.3 | 0.0 | 0.0 | 1.0 | 66.6 | ○ | present invention |
| D-6 | 27.0 | 8.0 | 0.0 | 0.0 | 0.87 | 0.1 | 0.2 | 0.3 | 0.0 | 0.0 | 1.0 | 62.5 | ○ | present invention |
| D-7 | 30.0 | 0.0 | 0.0 | 0.0 | 0.87 | 0.1 | 0.2 | 0.0 | 0.0 | 0.0 | 1.0 | 67.8 | ○ | present invention |
| D-8 | 17.0 | 13.0 | 0.0 | 0.0 | 0.87 | 0.1 | 0.2 | 0.0 | 0.0 | 0.0 | 1.0 | 67.8 | ○ | present invention |
| D-9 | 24.0 | 9.0 | 0.5 | 0.0 | 0.88 | 0.2 | 0.2 | 0.0 | 0.0 | 0.0 | 1.0 | 64.3 | ○ | present invention |
| D-10 | 24.0 | 9.0 | 0.5 | 0.0 | 0.88 | 0.2 | 0.2 | 0.2 | 0.0 | 0.0 | 1.0 | 64.1 | ○ | present invention |
| D-11 | 24.0 | 9.0 | 0.5 | 0.0 | 0.88 | 0.2 | 0.2 | 0.3 | 0.0 | 0.0 | 1.0 | 64.0 | ○ | present invention |
| D-12 | 24.0 | 9.0 | 0.5 | 0.0 | 0.88 | 0.2 | 0.2 | 0.5 | 0.0 | 0.0 | 1.0 | 63.8 | ○ | present invention |
| D-13 | 24.0 | 9.0 | 0.5 | 0.0 | 0.88 | 0.2 | 0.2 | 0.8 | 0.0 | 0.0 | 1.0 | 63.5 | ○ | present invention |
| D-14 | 24.0 | 9.0 | 0.5 | 0.0 | 0.88 | 0.2 | 0.2 | 1.2 | 0.0 | 0.0 | 1.0 | 63.1 | ○ | comparative example |
| D-15 | 24.0 | 7.0 | 0.0 | 1.0 | 0.88 | 0.2 | 0.1 | 0.3 | 0.2 | 0.0 | 1.0 | 65.4 | ○ | present invention |
| D-16 | 24.0 | 7.0 | 0.0 | 1.0 | 0.88 | 0.2 | 0.1 | 0.3 | 0.0 | 0.5 | 1.0 | 65.1 | ○ | present invention |

A Pr—Ga alloy was produced by a similar method to Example 1, except for being adjusted so that the Pr—Ga alloy had a composition indicated at d-1 in Table 14.

TABLE 14

| | composition of Pr—Ga alloy (mass %) | |
|---|---|---|
| No. | Pr | Ga |
| d-1 | 89 | 11 |

After processing the sintered R-T-B based magnet work (Nos. D-1 to D-16) in a manner similar to Example 1, the Pr—Ga alloy was spread on the sintered R-T-B based magnet work in a manner similar to No. 1 of Example 1; a first heat treatment was performed, and the sintered R-T-B based magnet work having been subjected to the first heat treatment was further subjected to a second heat treatment, thereby producing a sintered R-T-B based magnet (Nos. 26 to 41). The producing conditions (the types of sintered R-T-B based magnet work and Pr—Ga alloy and the temperatures of the first heat treatment and the second heat treatment) are shown in Table 15. Note that the cooling condition after performing the first heat treatment, down to room temperature, was similar to that of Example 1.

TABLE 15

| | producing conditions | | | |
|---|---|---|---|---|
| No. | sintered R-T-B based magnet work | Pr—Ga alloy | 1st heat treatment | 2nd heat treatment |
| 26 | D-1 | d-1 | 900° C. | 500° C. |
| 27 | D-2 | d-1 | 900° C. | 500° C. |
| 28 | D-3 | d-1 | 900° C. | 500° C. |
| 29 | D-4 | d-1 | 900° C. | 500° C. |
| 30 | D-5 | d-1 | 900° C. | 500° C. |
| 31 | D-6 | d-1 | 900° C. | 500° C. |
| 32 | D-7 | d-1 | 900° C. | 500° C. |
| 33 | D-8 | d-1 | 900° C. | 500° C. |
| 34 | D-9 | d-1 | 900° C. | 500° C. |
| 35 | D-10 | d-1 | 900° C. | 500° C. |
| 36 | D-11 | d-1 | 900° C. | 500° C. |

TABLE 15-continued

| No. | producing conditions: sintered R-T-B based magnet work | Pr—Ga alloy | 1st heat treatment | 2nd heat treatment |
|---|---|---|---|---|
| 37 | D-12 | d-1 | 900° C. | 500° C. |
| 38 | D-13 | d-1 | 900° C. | 500° C. |
| 39 | D-14 | d-1 | 900° C. | 500° C. |
| 40 | D-15 | d-1 | 900° C. | 500° C. |
| 41 | D-16 | d-1 | 900° C. | 500° C. |

Each resultant sample was processed similarly to Example 1, and subjected to measurement under a similar method, thus determining $B_r$ and $H_{cJ}$. The results are shown in Table 16.

TABLE 16

| No. | $B_r$ (T) | $H_{cJ}$ (kA/m) | Notes |
|---|---|---|---|
| 26 | 1.40 | 900 | comparative example |
| 27 | 1.37 | 1570 | present invention |
| 28 | 1.36 | 1600 | present invention |
| 29 | 1.34 | 1580 | present invention |
| 30 | 1.33 | 1550 | present invention |
| 31 | 1.30 | 1750 | present invention |
| 32 | 1.39 | 1530 | present invention |
| 33 | 1.37 | 1700 | present invention |
| 34 | 1.34 | 1700 | present invention |
| 35 | 1.34 | 1730 | present invention |
| 36 | 1.34 | 1750 | present invention |
| 37 | 1.32 | 1680 | present invention |
| 38 | 1.31 | 1600 | present invention |
| 39 | 1.29 | 1580 | comparative example |
| 40 | 1.36 | 1810 | present invention |
| 41 | 1.36 | 1830 | present invention |

As shown in Table 16, Nos. 27 to 38 and Nos. 40 and 41, which are embodiments of the present invention, attained magnetic properties as high as $B_r \geq 1.30$ T and $H_{cJ} \geq 1490$ kA/m. On the other hand, magnetic properties as high as $B_r \geq 1.30$ T and $H_{cJ} \geq 1490$ kA/m were not attained by: No. 26, in which the composition of the sintered R-T-B based magnet work did not satisfy Inequality (1) of the present invention; and No. 39, in which the Ga content in the sintered R-T-B based magnet work was outside the range of the present invention. Moreover, as is clear from Nos. 34 to 38 (in which the Ga content in the sintered R-T-B based magnet work was 0 mass % to 0.8 mass %), the Ga content in the sintered R-T-B based magnet work is preferably 0.5 mass % or less, at which higher $H_{cJ}$ ($H_{cJ} \geq 1680$ kA/m) is being achieved.

Example 5

A sintered R-T-B based magnet work was produced by a similar method to Example 1, except that the sintered R-T-B based magnet work was adjusted to have the composition indicated at No. E-1 in Table 17.

TABLE 17

| No. | composition of sintered R-T-B based magnet work (mass %): Nd | Pr | Dy | Tb | B | Cu | Al | Ga | Zr | Nb | Co | Fe | Inequality (1) |
|---|---|---|---|---|---|---|---|---|---|---|---|---|---|
| E-1 | 24.0 | 7.0 | 0.0 | 0.0 | 0.88 | 0.1 | 0.1 | 0.2 | 0.0 | 0.0 | 1.0 | 67.1 | ○ |

Pr—Ga alloys were produced by a similar method to Example 1, except for being adjusted so that the Pr—Ga alloys had compositions indicated at e-1 and e-2 in Table 18.

TABLE 18

| No. | composition of Pr—Ga alloy (mass %): Pr | Ga | Cu |
|---|---|---|---|
| e-1 | 89 | 8 | 3 |
| e-2 | 89 | 11 | 0 |

After processing the sintered R-T-B based magnet work (No. E-1) in a manner similar to Example 1, the Pr—Ga alloy was spread on the sintered R-T-B based magnet work in a manner similar to No. 1 of Example 1; a first heat treatment was performed, and the sintered R-T-B based magnet work having been subjected to the first heat treatment was further subjected to a second heat treatment, thereby producing a sintered R-T-B based magnet (Nos. 42 to 51). The producing conditions (the types of sintered R-T-B based magnet work and Pr—Ga alloy and the temperatures of the first heat treatment and the second heat treatment) are shown in Table 19. Note that the cooling condition after performing the first heat treatment, down to room temperature, was similar to that of Example 1.

TABLE 19

| No. | producing conditions: sintered R-T-B based magnet work | Pr—Ga alloy | 1st heat treatment | 2nd heat treatment | Notes |
|---|---|---|---|---|---|
| 42 | E-1 | e-1 | 600° C. | 500° C. | present invention |
| 43 | E-1 | e-2 | 800° C. | 500° C. | present invention |
| 44 | E-1 | e-2 | 900° C. | 500° C. | present invention |
| 45 | E-1 | e-2 | 950° C. | 500° C. | present invention |
| 46 | E-1 | e-2 | 1050° C. | 500° C. | comparative example |
| 47 | E-1 | e-2 | 800° C. | 700° C. | present invention |
| 48 | E-1 | e-2 | 900° C. | 720° C. | present invention |
| 49 | E-1 | e-2 | 900° C. | 800° C. | comparative example |
| 50 | E-1 | e-2 | 900° C. | 460° C. | present invention |
| 51 | E-1 | e-2 | 600° C. | 400° C. | comparative example |

Each resultant sample was processed similarly to Example 1, and subjected to measurement under a similar method, thus determining $B_r$ and $H_{cJ}$. The results are shown in Table 20.

TABLE 20

| No. | $B_r$ (T) | $H_{cJ}$ (kA/m) | Notes |
|---|---|---|---|
| 42 | 1.36 | 1590 | present invention |
| 43 | 1.36 | 1610 | present invention |

TABLE 20-continued

| No. | $B_r$ (T) | $H_{cJ}$ (kA/m) | Notes |
|---|---|---|---|
| 44 | 1.36 | 1620 | present invention |
| 45 | 1.36 | 1580 | present invention |
| 46 | 1.34 | 1290 | comparative example |
| 47 | 1.36 | 1550 | present invention |
| 48 | 1.36 | 1500 | present invention |
| 49 | 1.37 | 1100 | comparative example |
| 50 | 1.36 | 1500 | present invention |
| 51 | 1.35 | 1150 | comparative example |

As shown in Table 20, Nos. 42 to 45, Nos. 47, 48 and 50, which are embodiments of the present invention, attained magnetic properties as high as $B_r \geq 1.30$ T and $H_{cJ} \geq 1490$ kA/m. On the other hand, magnetic properties as high as $B_r \geq 1.30$ T and $H_{cJ} \geq 1490$ kA/m were not attained by: No. 46, in which the first heat treatment was outside the range of the present invention; and Nos. 49 and 51, in which the second heat treatment was outside the range of the present invention.

Example 6

Sintered R-T-B based magnet works were produced by a similar method to Example 1, except that the sintered R-T-B based magnet works were adjusted to have the compositions indicated at Nos. F-1 and F-2 in Table 21.

TABLE 21

| | composition of sintered R-T-B based magnet work (mass %) | | | | | | | | | | | | |
|---|---|---|---|---|---|---|---|---|---|---|---|---|---|
| No. | Nd | Pr | Dy | Tb | B | Cu | Al | Ga | Zr | Nb | Co | Fe | Inequality (1) |
| F-1 | 19.0 | 7.0 | 0.0 | 4.0 | 0.88 | 0.1 | 0.2 | 0.5 | 0.1 | 0.0 | 1.0 | 68.2 | ○ |
| F-2 | 19.0 | 7.0 | 4.0 | 0.0 | 0.88 | 0.1 | 0.2 | 0.5 | 0.1 | 0.0 | 1.0 | 68.2 | ○ |

A Pr—Ga alloy was produced by a similar method to Example 1, except for being adjusted so that the Pr—Ga alloy had a composition indicated at f-1 in Table 22.

TABLE 22

| | composition of Pr—Ga alloy (mass %) | | |
|---|---|---|---|
| No. | Pr | Ga | Cu |
| f-1 | 89 | 11 | 0 |

After processing the sintered R-T-B based magnet work (Nos. F-1 and F-2) in a manner similar to Example 1, the Pr—Ga alloy was spread on the sintered R-T-B based magnet work in a manner similar to No. 1 of Example 1; a first heat treatment was performed, and the sintered R-T-B based magnet work having been subjected to the first heat treatment was further subjected to a second heat treatment, thereby producing a sintered R-T-B based magnet (Nos. 52 and 53). The producing conditions (the types of sintered R-T-B based magnet work and Pr—Ga alloy and the temperatures of the first heat treatment and the second heat treatment) are shown in Table 23. Note that the cooling down to room temperature after performing the first heat treatment was conducted by introducing an argon gas in the furnace, so that an average cooling rate of 10° C./minute existed from the temperature at which the heat treatment was effected (i.e., 900° C.) to 300° C. At the average cooling rate (10° C./minute), variation in the cooling rate (i.e., a difference between the highest value and the lowest value of the cooling rate) was within 3° C./minute.

TABLE 23

| | producing conditions | | | | |
|---|---|---|---|---|---|
| No. | sintered R-T-B based magnet work | Pr—Ga alloy | 1st heat treatment | 2nd heat treatment | Notes |
| 52 | F-1 | f-1 | 900° C. | 500° C. | present invention |
| 53 | F-2 | f-1 | 900° C. | 500° C. | present invention |

Each resultant sample was processed similarly to Example 1, and subjected to measurement under a similar method, thus determining $B_r$ and $H_{cJ}$. The results are shown in Table 24.

TABLE 24

| No. | $B_r$ (T) | $H_{cJ}$ (kA/m) | Notes |
|---|---|---|---|
| 52 | 1.30 | 2480 | present invention |
| 53 | 1.30 | 2210 | present invention |

As shown in Table 24, also in the case where the sintered R-T-B based magnet work contained Tb and Dy relatively profusely (4%), Nos. 52 and 53, which are embodiments of the present invention, attained high magnetic properties.

INDUSTRIAL APPLICABILITY

According to the present invention, a sintered R-T-B based magnet with high remanence and high coercivity can be produced. A sintered magnet according to the present invention is suitable for various motors such as motors to be mounted in hybrid vehicles, home appliance products, etc., that are exposed to high temperatures.

REFERENCE SIGNS LIST

12 main phase consisting of $R_2T_{14}B$ compound

14 grain boundary phase

**14*a*** double grain boundary phase

**14*b*** grain boundary triple junction

The invention claimed is:

1. A method for producing a sintered R-T-B based magnet, comprising:

a step of providing a sintered R-T-B based magnet work, containing

R: 27.5 to 35.0 mass % (where R is at least one rare-earth element which always includes Nd), B: 0.80 to 0.99 mass %, Ga: 0 to 0.8 mass %, and M: 0 to 2 mass % (where M is at least one of Cu, Al, Nb and Zr), and including a balance T (where T is Fe, or Fe and Co) and inevitable impurities, the sintered R-T-B based magnet work having a composition satisfying Inequality (1) below:

$$[T]/55.85>14[B]/10.8 \quad (1)$$

([T] is the T content by mass %; and [B] is the B content by mass %), the sintered R-T-B based magnet work including a main phase which consists of an $R_2T_{14}B$ compound, and including a grain boundary phase which is at grain boundaries of the main phase, wherein the sintered R-T-B based magnet work is formed by sintering particles each having a size of not less than 1 μm and not more than 10 μm;

a step of providing a Pr—Ga alloy (Pr accounts for 65 to 97 mass % of the entire Pr—Ga alloy; 20 mass % or less of Pr is replaceable by Nd; and 30 mass % or less of Pr is replaceable by Dy and/or Tb; Ga accounts for 3 mass % to 35 mass % of the entire Pr—Ga alloy; and 50% or less of Ga is replaceable by Cu; inclusion of inevitable impurities is possible);

a step of, while allowing at least a portion of the Pr—Ga alloy to be in contact with at least a portion of a surface of the sintered R-T-B based magnet work, performing a first heat treatment at a temperature which is greater than 600° C. but equal to or less than 950° C. in a vacuum or an inert gas ambient; and a step of performing a second heat treatment in a vacuum or an inert gas ambient for the sintered R-T-B based magnet work having been subjected to the first heat treatment, at a temperature which is lower than the temperature effected in the step of performing the first heat treatment but which is not less than 450° C. and not greater than 750° C., wherein the sintered R-T-B based magnet has a remanence $B_r \geq 1.30$ T and a coercivity $H_{cJ} \geq 1490$ kA/m.

2. The method for producing a sintered R-T-B based magnet of claim 1, wherein the Ga amount in the sintered R-T-B based magnet work is 0 to 0.5 mass %.

3. The method for producing a sintered R-T-B based magnet of claim 1, wherein the Nd content in the Pr—Ga alloy is equal to or less than the content of inevitable impurities.

4. The method for producing a sintered R-T-B based magnet of claim 1, wherein the sintered R-T-B based magnet having been subjected to the first heat treatment is cooled to 300° C. at a cooling rate of 5° C./minute or more, from the temperature at which the first heat treatment was performed.

5. The method for producing a sintered R-T-B based magnet of claim 4, wherein the cooling rate is 15° C./minute or more.

6. The method for producing a sintered R-T-B based magnet of claim 4, wherein an R-T-Ga phase is formed at the grain boundaries.

* * * * *